US005569890A

United States Patent [19]

Olsen

[11] Patent Number: 5,569,890

[45] Date of Patent: Oct. 29, 1996

[54] SEQUENCE SWITCH WITH FORCED DISCONNECT MECHANISM

[75] Inventor: David E. Olsen, Stephenson County, Ill.

[73] Assignee: Honeywell Inc., Minneapolis, Minn.

[21] Appl. No.: 390,727

[22] Filed: Feb. 17, 1995

[51] Int. Cl.[6] ..... H01H 15/18; H01H 5/30

[52] U.S. Cl. ..... 200/16 A; 200/448

[58] Field of Search ..... 200/1 R, 1 B, 200/5 R–5 F, 16 A, 18, 50 C, 402–472, 243

[56] References Cited

U.S. PATENT DOCUMENTS

| | | | |
|---|---|---|---|
| 1,831,368 | 11/1931 | Rubel | 200/6 B |
| 3,017,471 | 1/1962 | Karch | 200/447 |
| 3,192,329 | 6/1965 | Murrlé | 200/16 A |
| 3,612,793 | 10/1971 | Roeser | 200/448 |
| 3,764,761 | 10/1973 | Poltorak et al. | 200/447 |
| 3,769,474 | 10/1973 | Deubel et al. | 200/447 |
| 3,973,094 | 8/1976 | Kuhn | 200/443 |
| 4,216,358 | 8/1980 | Brozille | 200/447 |
| 4,347,415 | 8/1982 | Falchi | 200/441 |
| 5,283,406 | 2/1994 | Olson | 200/243 |

FOREIGN PATENT DOCUMENTS

| | | | |
|---|---|---|---|
| 1088083 | 10/1967 | United Kingdom | 200/448 |
| 1141038 | 1/1969 | United Kingdom | 200/448 |

*Primary Examiner*—J. R. Scott
*Attorney, Agent, or Firm*—William D. Lanyi

[57] ABSTRACT

A forced disconnect sequence switch is provided with a plunger that has two surfaces at its bottom portion. The two surfaces are disposed in planes which are displaced from each other so that cams can be actuated at different positions of travel of the plunger. The cams are sequentially rotatable to provide a positive break characteristic to the sequence switch. If either of the movable contact structures becomes welded to an associated stationary contact structure, each of the movable contacts are mechanically urged into separation sequentially by the cooperative action of the first and second surfaces of the plunger and their associated cams.

20 Claims, 6 Drawing Sheets

SEQUENCE SWITCH WITH FORCED DISCONNECT MECHANISM

BACKGROUND OF THE INVENTION

1. Field of the Invention

The present invention relates generally to sequence switches that are provided with a forced disconnect capability and, more particularly, to a double-pole double-throw switch that moves a first set of movable contacts prior to a second set of movable contacts and then forces the movement in the event that a failure of some type prevented the normal movement of the contacts.

2. Description of the Prior Art

Many different types of switches are well known to those skilled in the art. In addition, it is also known to provide a switch with a forced disconnect capability. This capability is also referred to as a positive break capability. The purpose for a forced disconnect characteristic in a switch is to mechanically force the movable contacts away from the stationary contacts in the event of a switch failure wherein the movable and stationary contacts become welded together. In switches that do not have this positive break characteristic, the movable and stationary contacts can be welded together and, even though the switch mechanism attempts to open the electrical connection, the movable and stationary contacts remain in electrical communication with each other because they are welded together. A positive break characteristic provides an additional mechanism that is able to force the disconnection of the movable and stationary contacts mechanically and break the weld connection.

U.S. Pat. No. 5,283,406, which issued to Olsen on Feb. 1, 1994, discloses a switch with a movable carrier to which movable contacts are attached. The switch is provided with a movable contact and a contact carrier that significantly facilitates the manufacturing process that is necessary to make the assembly. The contact carrier is provided with first and second extensions that are generally flexible and associated with each other to provide a gap therebetween. In the preferred embodiment of the device, the second extension comprises first and second fingers that extend from the contact carrier. The second extension is provided with protuberances that permit a movable contact to deform the second extension as it is moved inward toward the contact carrier. The extensions snap together after the complete movable contact has moved into a predetermined space between the extensions. The assembly of the present invention permits the movable contact to be permanently retained between the first and second extensions, but variably movable in position within that containment to permit the position of the movable contact to adjust to the position of the fixed contact with the contact carrier is moved within a housing structure to force the movable contacts into electrical communication with a pair of fixed contacts. The switch described in the. Olsen patent is a double-pole double-throw switch. In addition, it illustrates a positive break mechanism that comprises rotatable cams that can force the contacts open even though they may be welded together.

Sequence switches are known to those skilled in the art. The purpose of a sequence switch is to cause one set of movable and stationary contacts to move relative to each other prior to a similar relative movement between another set of stationary and movable contacts. When a switch of this type is connected to electrical circuitry, a first circuit can be energized or deenergized prior to a similar change in another circuit. The switch described in the Olsen patent does not provide this sequencing capability. Because of the necessity for a sequence switch to actuate or de-actuate one set of contacts prior to another set of contacts, the forced disconnect capability, or positive break capability, has not been implemented in sequencing switches. It would therefore be significantly beneficial if the capability to provide a forced disconnect mechanism was available in a sequence switch.

SUMMARY OF THE INVENTION

The present invention provides a sequence switch that has the capability of mechanically forcing its movable contacts away from its stationary contacts in the event that the contacts are welded together through a malfunction of the switch or associated circuitry. A switch made in accordance with the present invention comprises a housing and a carrier disposed within the housing. The carrier is movable within the housing. A plunger is disposed within the housing in a way that allows the plunger to be movable relative to the carrier and also movable relative to the housing.

A first stationary electrical contact structure is attached to the housing at a first side of the carrier and a second stationary electrical contact structure is attached to the housing at a second side of the carrier. First and second movable electrical contact structures are attached to the carrier at the first and second sides of the carrier, respectively. The movable electrical contact structures are able to be moved from a first position to a second position relative to the stationary electrical contact structures.

A first means is provided for causing the first movable electrical contact structure to move from a first position relative to a first stationary electrical contact structure to a second position relative to the first stationary electrical contact structure. Similar means are provided for causing the second movable electrical contact structure to move from a first position relative to the second stationary electrical contact structure to a second position relative to the second stationary electrical contact structure. A first means is provided for actuating the first and second causing means in a sequential order. In other words, the first and second causing means are not actuated simultaneously but, instead, according to a predetermined sequence.

A first means is provided for forcing the first movable electrical contact structure to move from the first position to the second position and a second means is provided for forcing the second movable electrical contact structure to move from the first position to the second position. In addition, a second means is provided for actuating the first and second forcing means in a sequential order. In other words, the forcing means are provided so that they can mechanically force the contacts apart in the event that they become welded together.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
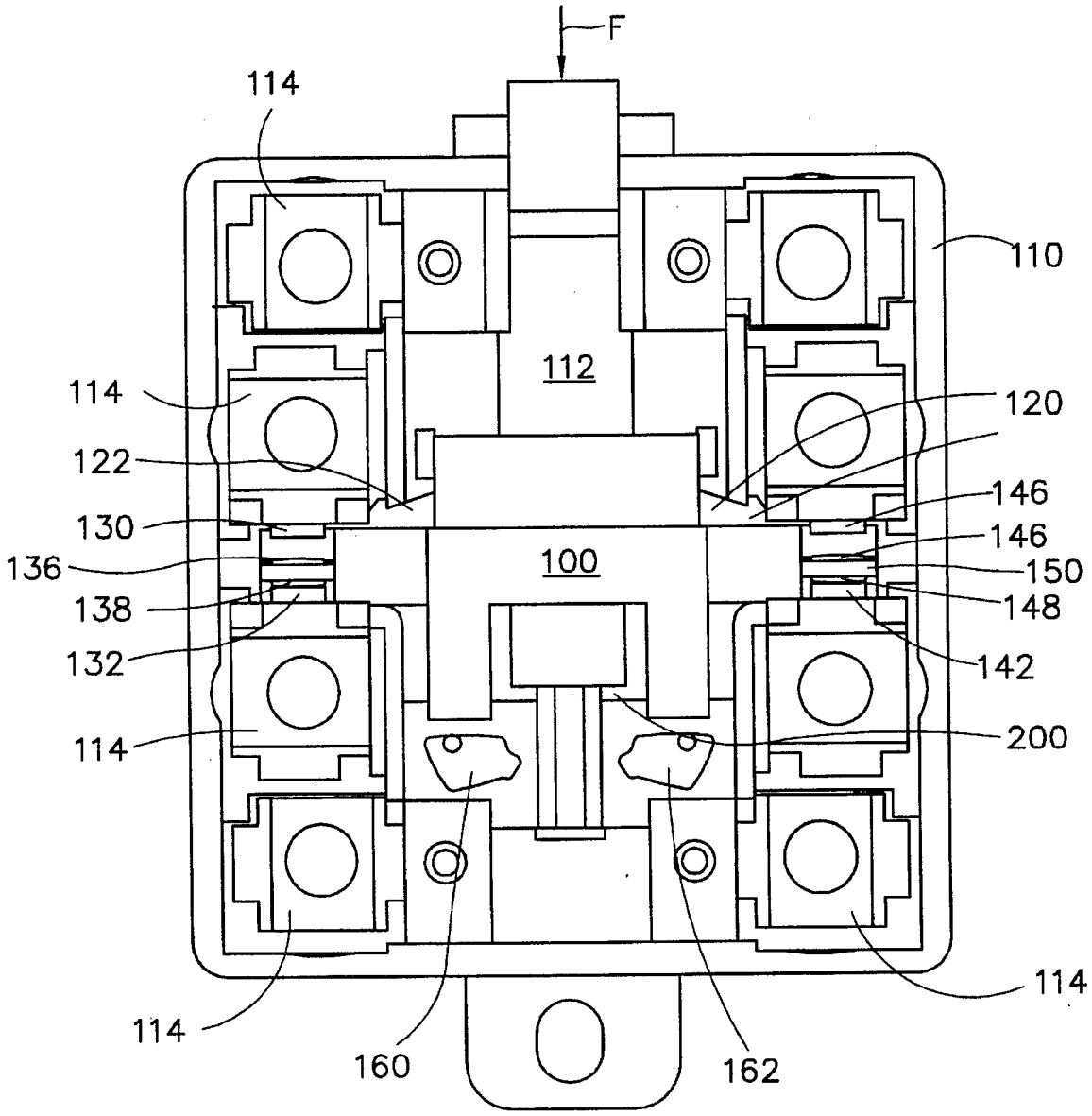
Fig. 1 PRIOR ART
FIGS. 1 and 2 show switches made in accordance with the prior art.

Throughout the Description of the Preferred Embodiment, like components will be identified by like reference numerals.

In U.S. Pat. No. 5,283,406, which is explicitly incorporated by reference herein, a double-pole double-throw switch is described in detail. Exploded views of a double-pole double-throw switch are clearly illustrated in U.S. Pat. No. 5,283,406 along with the cam structures that are used to provide the forced disconnect mechanism of the switch. These cams provide the positive break characteristic of the switch. However, it should be understood that the switch that is described in detail in U.S. Pat. No. 5,283,406 is not a sequence switch. In other words, the switch described and illustrated in U.S. Pat. No. 5,283,406 is intended to move both sets of movable contacts into and out of contact with the related stationary contacts simultaneously with no sequencing behavior. The present invention, on the other hand, is intended for use in switches that are specifically designed to operate as sequence switches. The present invention provides a means for allowing a sequence switch to also be a positive break, or forced disconnect, switch.

FIG. 1 illustrates the type of switch described in U.S. Pat. No. 5,283,406. It shows a switch similar to the one illustrated in FIG. 9 of U.S. Pat. No. 5,283,406. A carrier 100 is disposed within a housing 110. A plunger 112 is slideably disposed through the carrier 100 and is movable relative to both the carrier 100 and the housing 110. A plurality of connectors 114 are provided to permit the switch to be connected to external circuitry. Reference numeral 120 identifies a resilient pivot that will be described in greater detail below. Two resilient pivots, 120 and 122, are typically used in switches of this type. On a first side of the carrier, stationary contacts 130 and 132 are provided. Movable contact pads 136 and 138 are attached to the carrier 100 for movement with the carrier in an up and down manner. On a second side of the carrier 100, stationary contacts 140 and 142 are associated with electrical contact pads 146 and 148 which are attached to a support structure 150. Two cams, which are identified by reference numerals 160 and 162, are provided to force the carrier 100 in an upward direction in response to a full downward movement of the plunger 112. In other words, the plunger 112 causes the carrier 100 to move in an upward direction in response to the movement of the resilient pivot 120 after the plunger 112 moves downward a preselected distance. As the plunger 112 continues to move downward, its bottom portion eventually moves into contact with cams 160 and 162 and causes the cams to pivot about their central axes. This rotation of the cams pushes upward against the bottom portion of the carrier 100 if the carrier 100 has not already moved upward. This mechanical action of the cams against the carrier 100 forces the movable contacts upward relative to the stationary contacts if the movable and stationary contacts are welded together through some malfunction of the system.

FIG. 1 shows the basic operation of a positive break, or forced disconnect, switching mechanism. The plunger 112 is caused to move downward by a force such as that indicated by arrow F in FIG. 1. This downward movement of the plunger 112 causes the actuation and de-actuation of the switch and also causes the mechanical action of the cams 160 and 162.

Figure 2:
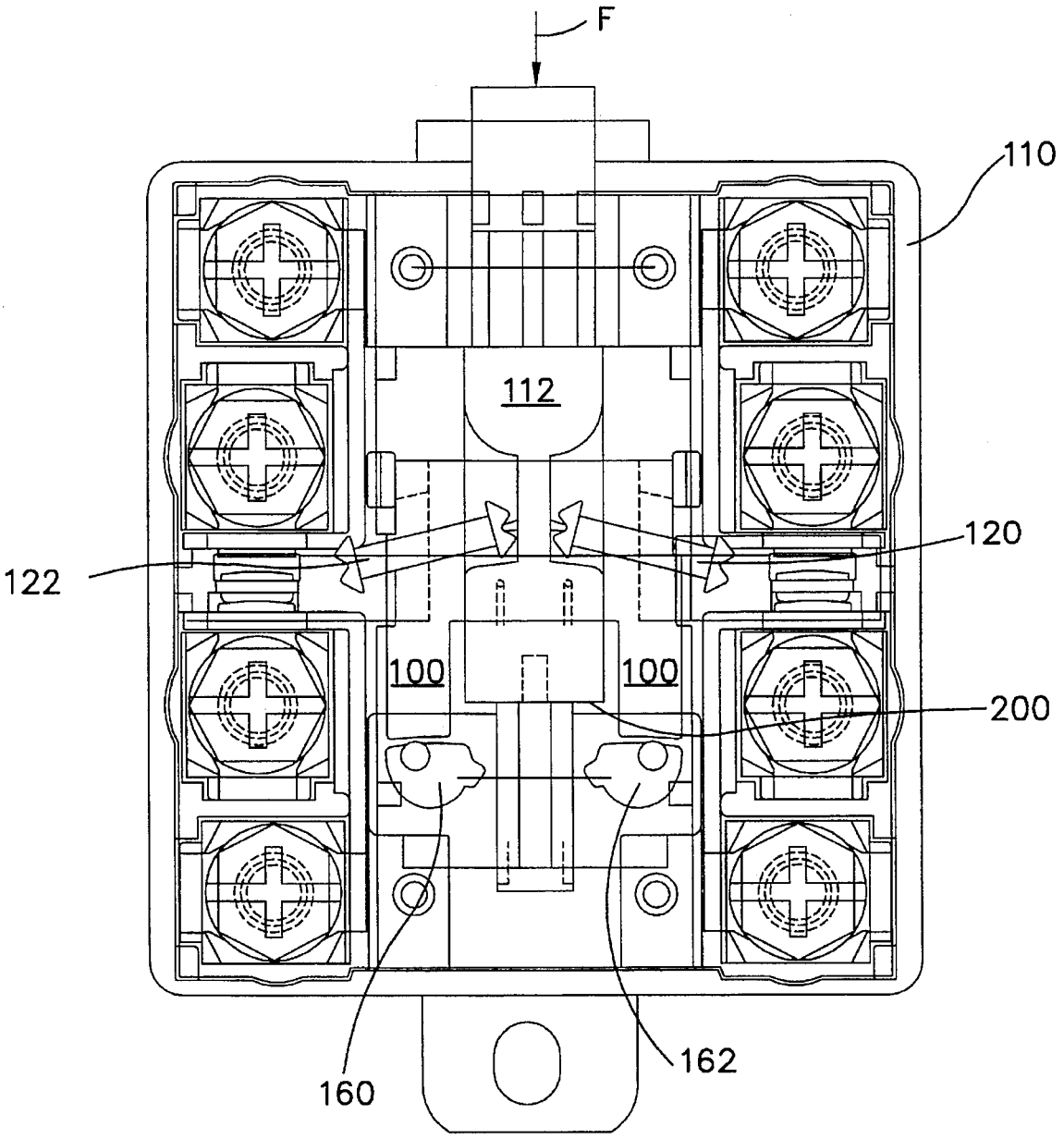
Fig. 2 PRIOR ART

FIG. 2 shows an alternative representation of the switch illustrated in FIG. 1. The illustration of FIG. 2 permits certain components to be seen which would otherwise be hidden behind other portions of the switch. More specifically, the resilient pivots, 120 and 122, are illustrated in their operative positions. Both of these resilient pivots are pivotably attached to the plunger 112 and the carrier 110. In other words, one end of each resilient pivot is pivotably associated with a pivot point on the plunger 112. The other end of both resilient pivots is pivotably associated with a pivot point on the carrier. The basic operation of a switch like the one shown in FIG. 2 is that a downward movement of the plunger 112 eventually causes the pivot points of the plunger 112 to move below the pivot points on the carrier 100. When this occurs, the resilient portion of the resilient pivots forces the plunger and carrier away from each other with the carrier 100 moving upward and the plunger 112 continuing in a downward movement. As the plunger 112 continues downward in response to force F, the bottom surface 200 of the plunger 112 moves into contact with a portion of the cams, 160 and 162, and causes the cams to rotate about their central axes. This rotation of cam 160 in a clockwise direction and of cam 162 in a counterclockwise direction causes the cams to push upward against the bottom surfaces of the legs of the carrier 100. Switches of this type are available and are known to those skilled in the art.

Figure 3:
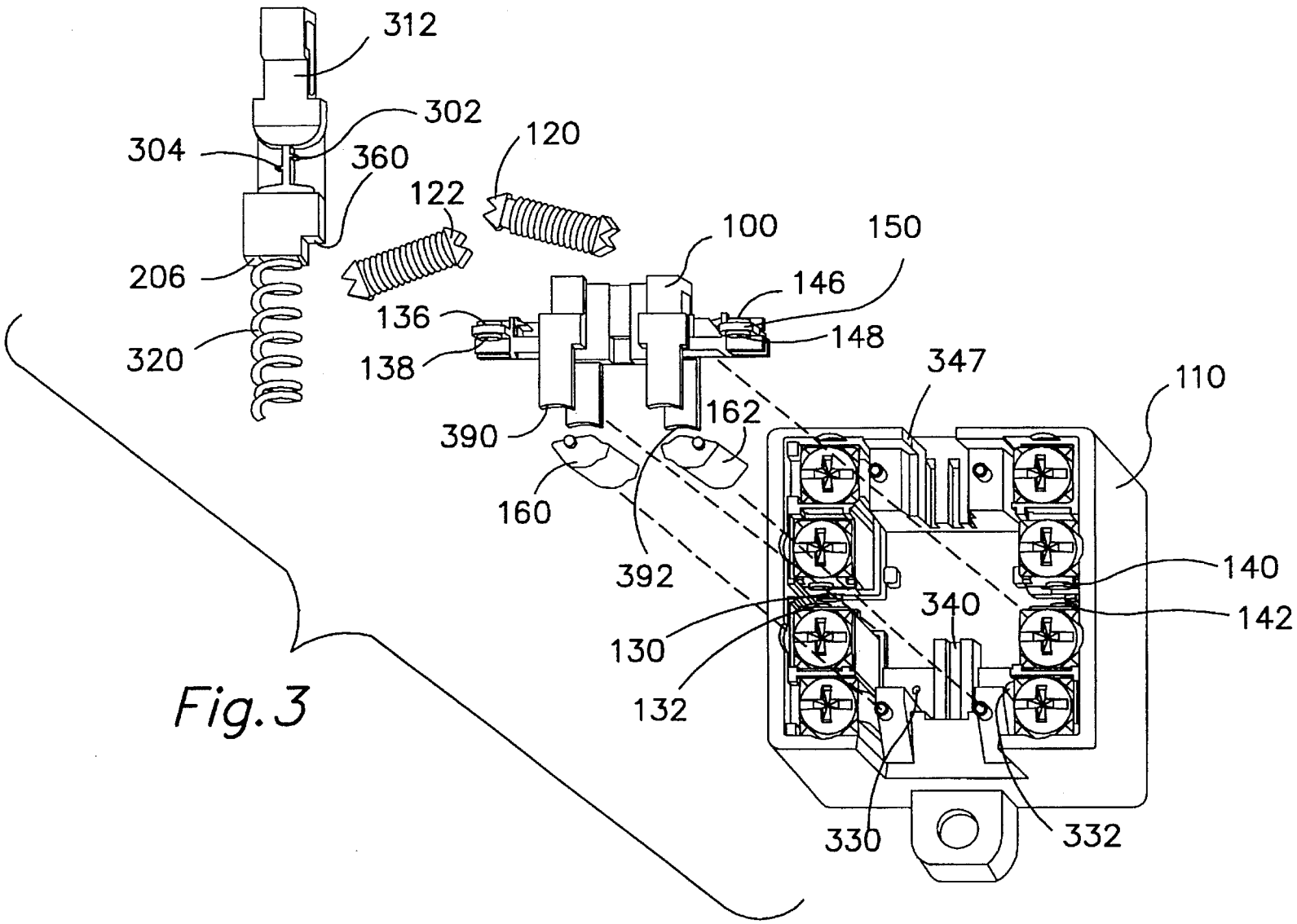
FIG. 3 is an exploded perspective view of a switch made in accordance with the present invention.

FIG. 3 illustrates an exploded view of a switch made in accordance with the present invention. Certain portions of the switch shown in FIG. 3 are similar to those described above in conjunction with FIGS. 1 and 2. For example, the carrier 100 is functionally similar to the carrier described above and shown in FIGS. 1 and 2. Likewise, the resilient pivots, 120 and 122, operate in a manner generally similar to that described above. The plunger 312 is slightly different than the plunger 112 described above. For example, the pivot points, 302 and 304, are offset from each other to provide a sequencing of the movement of the carrier 100. This sequencing characteristic, which is generally known to those skilled in the art, will be described in greater detail below. The plunger 312 is provided with a return spring 320 that causes it to move back to its original position when a force F is removed. The cams, 160 and 162, are similar to those described above.

With continued reference to FIG. 3, the cams are disposed on their axes, 330 and 332, so that they can pivot relative to the housing 110. The carrier 100 is disposed within the housing and associated with the alignment track 340 to control its upward and downward movement relative to the housing 110. The plunger 312 is inserted through the carrier 100 and aligned with opening 347.

When cams, 160 and 162, rotate about their axes, 330 and 332, they are caused to push upwardly against surfaces, 390 and 392, of the carrier 100. This upward movement provides the positive break, or forced disconnect, feature of the switch. With reference to the plunger 312 shown in FIG. 3, an important difference between its shape and the shape of the plunger 112 described above can be seen. The bottom surface 200 of plunger 312 is provided with a discontinuity that creates an additional surface 360. Surfaces 200 and 360 are disposed in planes which are displaced from each other. When plunger 312 is inserted within housing 110, the two surfaces, 200 and 360, are at different heights relative to the plane in which the axes, 330 and 332 are disposed. This also places surfaces 200 and 360 at different distances from cams 160 and 162 than was the case in FIGS. 1 and 2. In other words, surface 200 of plunger 112 in FIGS. 1 and 2 is displaced from cams 160 and 162 by a constant distance. When the surface 200 moved into contact with one of the cams, it moved into contact with the other cam simultaneously.

Figure 4:
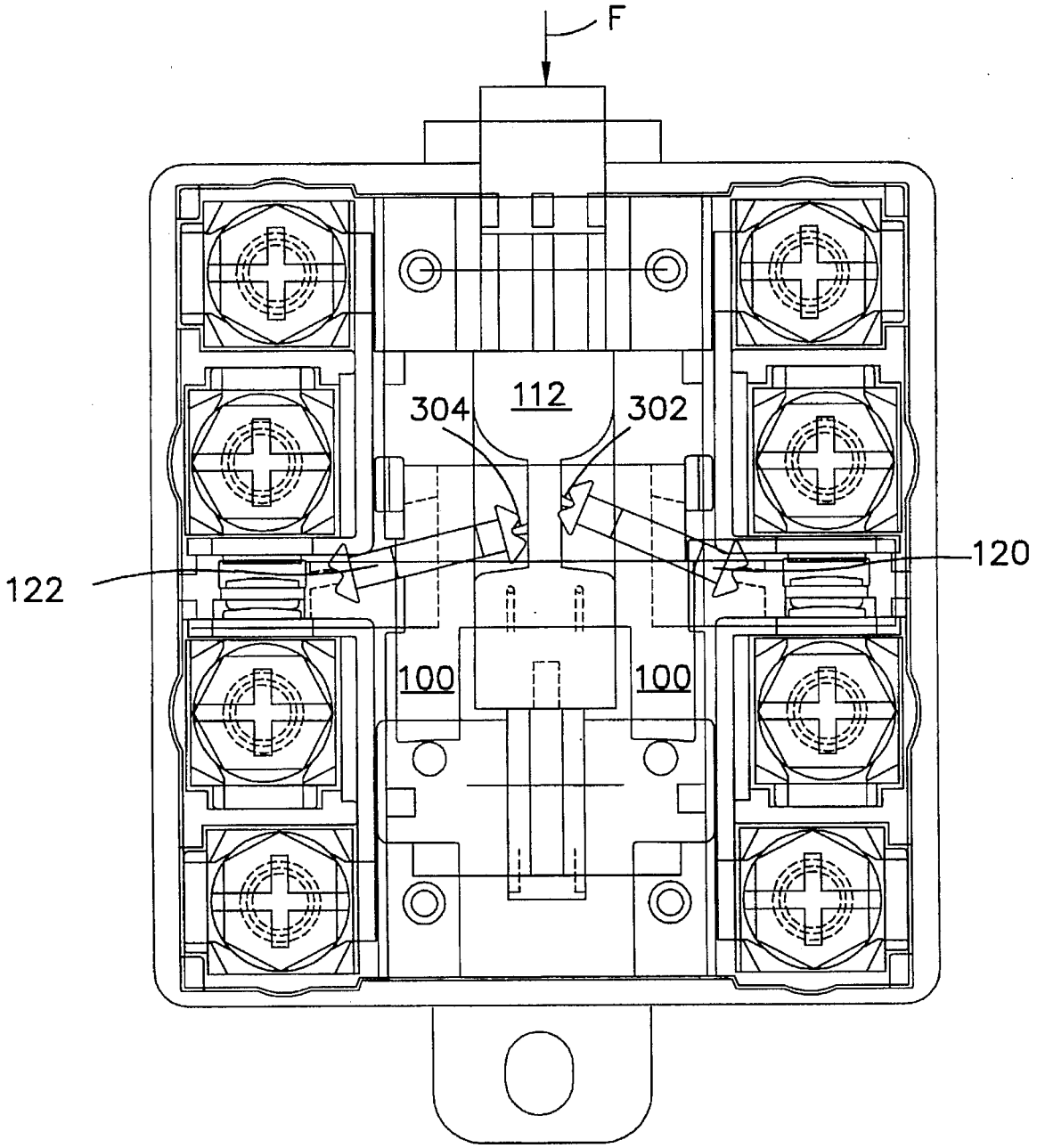
Fig. 4 PRIOR ART
FIG. 4 is a sequence switch made in accordance with the prior art.

FIG. 4 is generally similar to FIG. 2, but illustrates a known structure for providing a sequence switch which is available in commercial quantities from the MICRO SWITCH division of Honeywell Incorporated and is identified as Catalog No. GLZ321 as a basic switch and Catalog No. GLAA21B as a complete limit switch. Since the resilient pivots, 120 and 122, are associated with pivot points, 302 and 304, which are displaced from each other in an offset manner as shown in FIG. 4, the movable contacts on the left side of the carrier 100 operate sequentially before the moveable contacts on the right side of the carrier 100. As the plunger 112 moves downward in response to force F, resilient pivot 122 moves into a generally horizontal position prior to resilient pivot 120 moving into a generally horizontal position. This results from the fact that pivot point 302 is higher than pivot point 304. Therefore, as resilient pivot 122 moves into its over center position and begins to expand, the movable contacts on the left side of the carrier 100 will move out of contact with the lower stationary contacts and into contact with the upper stationary contacts on the left side of the switch. This occurs prior to a similar action by the movable contacts on the right side of the switch. As plunger 112 continues to move downward, resilient pivot 120 eventually moves into a horizontal position and then begins to expand after it reaches an over center position. This expansion then causes the right side of the carrier 100 to move upward and move its movable contacts from electrical communication with the lower stationary contacts on the right side of the switch toward a second position where they move into electrical communication with the upper stationary contacts on the right side of the switch. Therefore, the status of the movable contacts on the left side of the switch changes prior to the change in status of the movable contacts on the right side of the switch. This provides the sequencing nature of a switch. This sequencing nature is generally known to those skilled in the art and can be provided by applying several alternative techniques. However, because of this sequencing characteristic, it has been heretofore impossible to provide a positive break or forced disconnect characteristic to a sequencing switch. The normal manner of using cams to rotate in response to contact by the bottom surface 200 of the plunger 112 could not be applied because the movable contacts on the left side and right side of the carrier must be changed in status sequentially.

Figure 5:
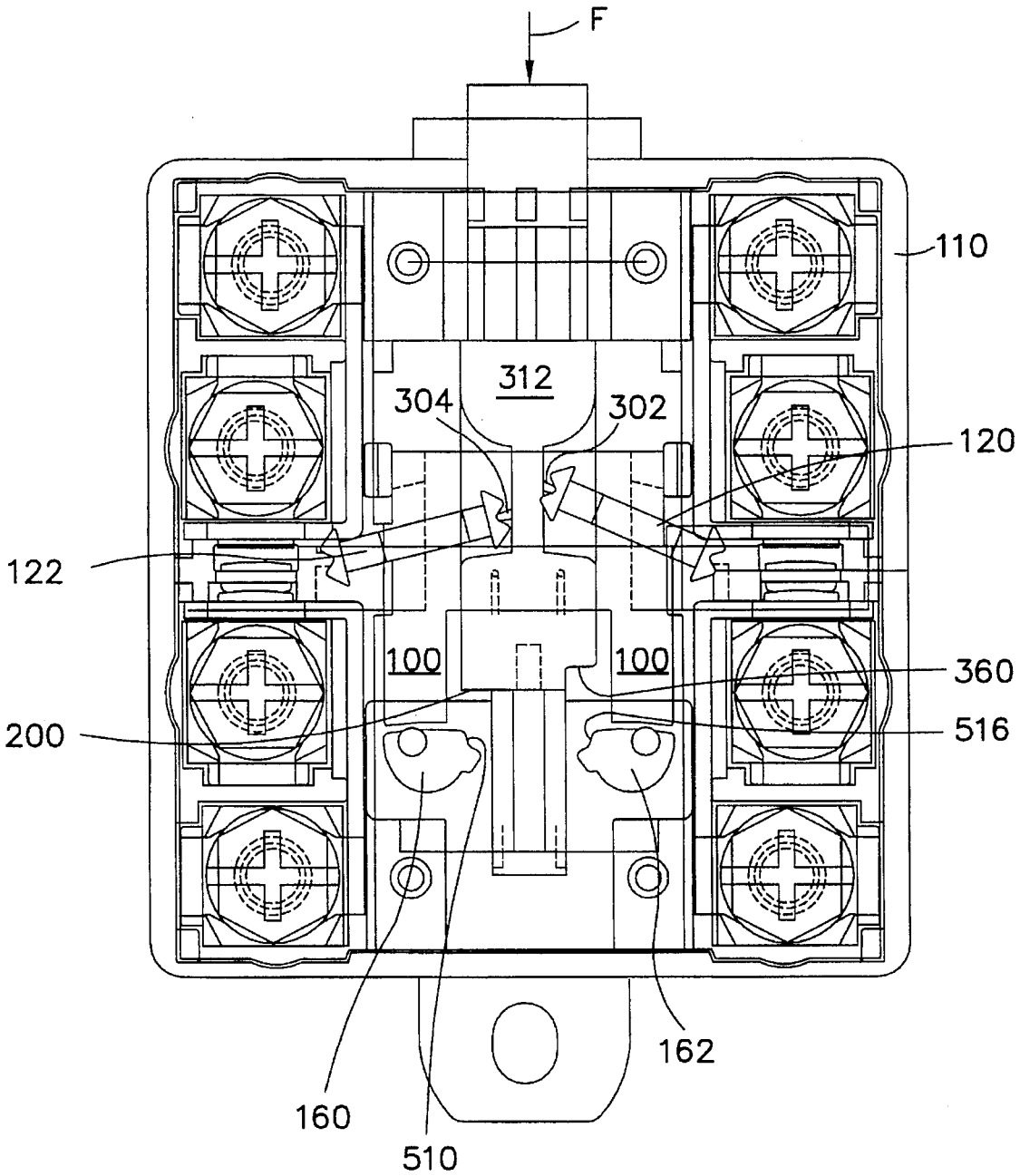
FIG. 5 is an illustration of a positive break sequence switch made in accordance with the present invention.

FIG. 5 illustrates a preferred embodiment of the present invention which combines the features of sequencing and positive break to a single switch. In operation, a downward force F on plunger 312 causes it to begin to move downward relative to the housing 110. This downward movement eventually causes resilient pivot 122 to move to a horizontal position and then snap over center to cause the movable contacts on the left side of the switch to move out of electrical contact with the lower stationary contacts on the left side of the switch and into electrical communication with the upper stationary contacts on the left side of the switch. As plunger 312 continues to move downward, resilient pivot 120 eventually moves into a generally horizontal position and then snaps over center to cause the right side of the carrier 100 to move upward. When this occurs, the movable contacts on the right side of the switch move upward relative to the housing 110 and out of electrical communication with the lower stationary contacts on the right side of the switch. This places the movable contacts into a second position where they are in electrical communication with the stationary contacts on the right side of the switch. Therefore, when the plunger 312 is at this position, the two movable contacts on the left and right sides of the carrier have sequentially changed their positions. Continued downward movement of the plunger 312 causes surface 200 of plunger 312 to move into contact with portion 510 of the cam 160. This contact rotates cam 160 clockwise about its central axis and moves the left side of cam 160 upward into physical contact with the lower surface of carrier 110 which is identified by reference numeral 390 in FIG. 3. When surface 200 moves into contact with cam 160, cam 162 is unaffected and remains in its unactuated position. Eventually, continued downward movement of plunger 312 moves surface 360 into contact with portion 516 of cam 162. This causes cam 162 to rotate in a counterclockwise direction about its central axis. This moves the right portion of cam 162 into contact with the lower surface of carrier 100 which is identified by reference numeral 392 in FIG. 3.

With continued reference to FIG. 5, it should be understood that the action of cam 160 provides a positive break for the movable and stationary contacts on the left side of the carrier 100 while cam 162 provides this same function for the movable and stationary contacts on the right side of the carrier 100. These two mechanical forced separations are provided sequentially in conformance with the intended operation of the sequence switch. Therefore, if either of the movable contacts becomes welded to the lower stationary contact, the action of the associated cam, 160 or 162, will separate the movable contact from its associated stationary contact. Therefore, the present invention makes possible the application of a positive break characteristic in conjunction with a sequence switch which has heretofore been unavailable.

Figure 6:
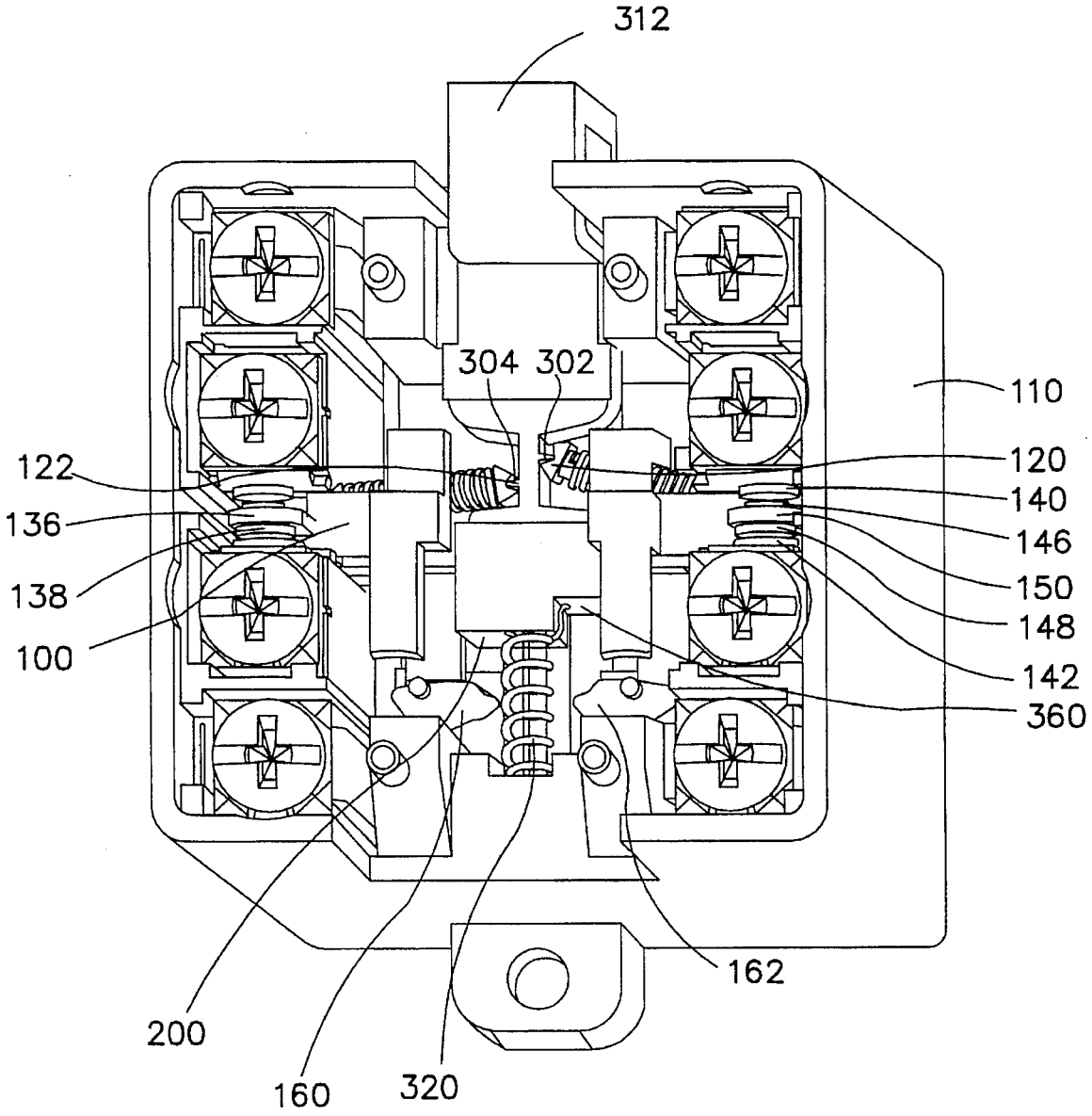
FIG. 6 is a perspective view of a forced disconnect sequence switch made in accordance with the present invention.

FIG. 6 is a perspective view of a forced disconnect sequence switch made in accordance with the present invention. The view provided by FIG. 6 illustrates the relative positions of the resilient pivots, 120 and 122, relative to the carrier 100 and also shows the plunger 312 in its position relative to the carrier 100. It should be understood that the upward and downward movement of the carrier 100 relative to the housing 110 is of only a slight magnitude which is sufficient to move the movable contacts in to and out of contact with the stationary contacts. It should also be understood that the structure of the resilient pivots, 120 and 122, is generally known to those skilled in the art. Each resilient pivot comprises first and second ends that are associated with each other through the central portion of a spring.

Although the present invention has been described in considerable detail to illustrate and disclose a preferred embodiment of the present invention, it should be understood that alternative embodiments are also within its scope.

The embodiments of the invention in which an exclusive property or right is claimed are defined as follows:

1. A switch, comprising:

a housing;

a carrier disposed within said housing, said carrier being movable within said housing;

a plunger disposed within said housing, said plunger being movable relative to said carrier, said plunger being movable relative to said housing;

a first stationary electrical contact structure attached to said housing at a first side of said carrier;

a second stationary electrical contact structure attached to said housing at a second side of said carrier;

a first movable electrical contact structure attached to said carrier at said first side of said carrier;

a second movable electrical contact structure attached to said carrier at said second side of said carrier;

first means for causing said first movable electrical contact structure to move from a first position relative to said first stationary electrical contact structure to a second position relative to said first stationary electrical contact structure;

second means for causing said second movable electrical contact structure to move from a first position relative to said second stationary electrical contact structure to a second position relative to said second stationary electrical contact structure;

first means for actuating said first and second causing means sequentially;

first means for forcing said first movable electrical contact structure to move from said first position relative to said first stationary electrical contact structure to said second position relative to said first stationary electrical contact structure;

second means for forcing said second movable electrical contact structure to move from said first position relative to said second stationary electrical contact structure to said second position relative to said second stationary electrical contact structure; and second means for actuating said first and second forcing means sequentially.

2. The switch of claim 1, wherein:

said first causing means comprises a first resilient pivot, said first resilient pivot being pivotably attached to said plunger and to said carrier; and said second causing means comprises a second resilient pivot, said second resilient pivot being pivotably attached to said plunger and to said carrier.

3. The switch of claim 1, wherein:

said first forcing means comprises a first cam.

4. The switch of claim 3, wherein:

said first cam is rotatably attached to said housing, said first cam being rotatable in response to contact with said plunger, said carrier being movable in response to rotation of said first cam.

5. The switch of claim 1, wherein:

said second forcing means comprises a second cam.

6. The switch of claim 5, wherein:

said second cam is rotatably attached to said housing, said second cam being rotatable in response to contact with said plunger, said carrier being movable in response to rotation of said second cam.

7. The switch of claim 1, wherein:

said first stationary electrical contact structure comprises a first electrically conductive pad at said first position relative to said first stationary electrical contact structure and a second electrically conductive pad at said second position relative to said first stationary electrical contact structure.

8. The switch of claim 1, wherein:

said second stationary electrical contact structure comprises a first electrically conductive pad at said first position relative to said second stationary electrical contact structure and a second electrically conductive pad at said second position relative to said second stationary electrical contact structure.

9. The switch of claim 1, wherein:

said second actuating means comprises first and second surfaces of said plunger, said first and second surfaces being disposed in planes which are displaced apart from each other.

10. The switch of claim 9, wherein:

said second surface is disposed in a notch formed in said plunger.

11. A switch, comprising:

a housing;

a carrier disposed within said housing, said carrier being movable within said housing;

a plunger disposed within said housing, said plunger being movable relative to said carrier, said plunger being movable relative to said housing;

a first stationary electrical contact structure attached to said housing at a first side of said carrier;

a second stationary electrical contact structure attached to said housing at a second side of said carrier;

a first movable electrical contact structure attached to said carrier at said first side of said carrier;

a second movable electrical contact structure attached to said carrier at said second side of said carrier;

first means for causing said first movable electrical contact structure to move from a first position relative to said first stationary electrical contact structure to a second position relative to said first stationary electrical contact structure;

second means for causing said second movable electrical contact structure to move from a first position relative to said second stationary electrical contact structure to a second position relative to said second stationary electrical contact structure;

first means for actuating said first and second causing means sequentially;

first means for forcing said first movable electrical contact structure to move from said first position relative to said first stationary electrical contact structure to said second position relative to said first stationary electrical contact structure;

second means for forcing said second movable electrical contact structure to move from said first position relative to said second stationary electrical contact structure to said second position relative to said second stationary electrical contact structure; and second means for actuating said first and second forcing means sequentially, said first causing means comprising a first resilient pivot, said first resilient pivot being pivotably attached to said plunger and to said carrier, said second causing means comprising a second resilient pivot, said second resilient pivot being pivotably attached to said plunger and to said carrier.

12. The switch of claim 11, wherein:

said first forcing means comprises a first cam.

13. The switch of claim 12, wherein:

said first cam is rotatably attached to said housing, said first cam being rotatable in response to contact with said plunger, said carrier being movable in response to rotation of said first cam.

14. The switch of claim 11, wherein:

said second forcing means comprises a second cam.

15. The switch of claim 14, wherein:

said second cam is rotatably attached to said housing, said second cam being rotatable in response to contact with said plunger, said carrier being movable in response to rotation of said second cam.

16. The switch of claim 11, wherein:

said first stationary electrical contact structure comprises a first electrically conductive pad at said first position relative to said first stationary electrical contact structure and a second electrically conductive pad at said second position relative to said first stationary electrical contact structure.

17. The switch of claim 11, wherein:

said second stationary electrical contact structure comprises a first electrically conductive pad at said first position relative to said second stationary electrical contact structure and a second electrically conductive pad at said second position relative to said second stationary electrical contact structure.

18. The switch of claim 11, wherein:

said second actuating means comprises first and second surfaces of said plunger, said first and second surfaces being disposed in planes which are displaced apart from each other.

19. The switch of claim 18, wherein:

said second surface is disposed in a notch formed in said plunger.

20. A switch, comprising:

a housing;

a carrier disposed within said housing, said carrier being movable within said housing;

a plunger disposed within said housing, said plunger being movable relative to said carrier, said plunger being movable relative to said housing;

a first stationary electrical contact structure attached to said housing at a first side of said carrier;

a second stationary electrical contact structure attached to said housing at a second side of said carrier;

a first movable electrical contact structure attached to said carrier at said first side of said carrier;

a second movable electrical contact structure attached to said carrier at said second side of said carrier;

first means for causing said first movable electrical contact structure to move from a first position relative to said first stationary electrical contact structure to a second position relative to said first stationary electrical contact structure;

second means for causing said second movable electrical contact structure to move from a first position relative to said second stationary electrical contact structure to a second position relative to said second stationary electrical contact structure;

first means for actuating said first and second causing means sequentially;

first means for forcing said first movable electrical contact structure to move from said first position relative to said first stationary electrical contact structure to said second position relative to said first stationary electrical contact structure;

second means for forcing said second movable electrical contact structure to move from said first position relative to said second stationary electrical contact structure to said second position relative to said second stationary electrical contact structure; and second means for actuating said first and second forcing means sequentially, said first causing means comprising a first resilient pivot, said first resilient pivot being pivotably attached to said plunger and to said carrier, said second causing means comprising a second resilient pivot, said second resilient pivot being pivotably attached to said plunger and to said carrier, said first forcing means comprising a first cam, said first cam being rotatably attached to said housing, said first cam being rotatable in response to contact with said plunger, said carrier being movable in response to rotation of said first cam, said second forcing means comprising a second cam, said second cam being rotatably attached to said housing, said second cam being rotatable in response to contact with said plunger, said carrier being movable in response to rotation of said second cam, said first stationary electrical contact structure comprising a first electrically conductive pad at said first position relative to said first stationary electrical contact structure and a second electrically conductive pad at said second position relative to said first stationary electrical contact structure, said second stationary electrical contact structure comprising a first electrically conductive pad at said first position relative to said second stationary electrical contact structure and a second electrically conductive pad at said second position relative to said second stationary electrical contact structure, said second actuating means comprising first and second surfaces of said plunger, said first and second surfaces being disposed in planes which are displaced apart from each other, said second surface being disposed in a notch formed in said plunger.

* * * * *